US005346190A

United States Patent [19]

Dabney

[11] Patent Number: 5,346,190

[45] Date of Patent: Sep. 13, 1994

[54] BOX SPRING ASSEMBLY SUPPORT SPRING

[75] Inventor: Upton R. Dabney, Lexington, Ky.

[73] Assignee: Hoover Group, Inc., Alpharetta, Ga.

[21] Appl. No.: 20,745

[22] Filed: Feb. 22, 1993

[51] Int. Cl.[5] ..... F16F 3/00; A47C 25/00

[52] U.S. Cl. ..... 267/95; 267/103; 267/165; 5/247; 5/255

[58] Field of Search ..... 5/247, 255, 476; 267/103, 105, 106, 165

[56] References Cited

U.S. PATENT DOCUMENTS

| | | | |
|---|---|---|---|
| 3,286,281 | 2/1965 | Slominski | 5/247 |
| 4,251,892 | 2/1981 | Hancock | 5/255 |
| 4,377,279 | 3/1983 | Schulz, Jr. et al. | 5/247 |
| 4,666,136 | 5/1987 | Hagemeister | 5/247 |
| 4,685,659 | 8/1987 | Hagemeister | 5/247 |
| 4,729,550 | 3/1988 | Hagemeister | 5/247 |
| 4,730,358 | 3/1988 | Zapletal | 5/247 |
| 4,805,883 | 2/1989 | Kitchen | 5/275 |
| 4,862,532 | 9/1989 | Wells et al. | 5/247 |
| 5,052,064 | 10/1991 | Hamemeister et al. | 5/246 |

*Primary Examiner*—Alexander Grosz
*Attorney, Agent, or Firm*—Harness, Dickey & Pierce

[57] ABSTRACT

A box spring assembly which having a frame, a plurality of upwardly extending wire springs mounted on the frame and a wire deck supported by the springs so that the deck and springs cooperate to yieldably resists downwardly directed bedding loads. Each of the springs has a body comprised of a pair of side-by-side yieldable portions connected at their upper ends by a mounting bar. The yieldable portions include an upper column section and a lower column section connected by a middle section. The middle section is configured to bend in a substantially vertical plane in response to the downwardly directed load. Mounting feet extend from the lower ends of the yieldable portions and enable securement of the spring to the frame. The use of bending stresses in the springs to resist the bedding load produces a spring which stimulates a non-spring system in effective firmness while improving deformation resistance under normal abuse conditions.

19 Claims, 3 Drawing Sheets

BOX SPRING ASSEMBLY SUPPORT SPRING

BACKGROUND AND SUMMARY OF THE INVENTION

This invention relates generally to mattress foundation structures. More particularly, this invention relates to a box spring assembly of the typed which utilizes non-coil springs.

Box spring assemblies using non-coil springs have been known since 1964, the first such spring assembly known to applicant being disclosed in U.S. Pat. No. 3,286,281. Box spring assemblies of this general type are advantageous with respect to conventional box spring assemblies using coil springs because they provide a stiffer foundation for the mattress and contain a reduced amount of spring wire. These box spring assemblies are also advantageous from standpoints of prolonged service life, ease of assembly, and cost of manufacture.

Mattress foundation structures which utilize non-springs, often referred to as wire forms, are also known. Examples of this type of mattress foundation are disclosed in U.S. Pat. Nos. 4,377,279 and 5,052,064. Non-spring or wire form mattress foundation structures, when used in cooperation with a mattress, offer increased stiffness and support. This is especially desirable around the perimeter of the foundation structure. As such, the non-spring mattress foundation structure prevents significant localized deflection of the mattress and mattress foundation when a person is sitting on the edge of the bed. This in turn eliminates the "sliding off" feeling typically associated with less stiff or soft mattress foundations and box spring assemblies.

While the non-spring mattress foundation structures exhibit benefits with respect to perimeter stiffness, they also exhibit an inherent limitation as a result of this increased stiffness. While not being apparent during normal use conditions, this limitation can arise under "normal" abuse conditions. Examples of normal abuse conditions, as this term is used herein, would include impact loads resulting from a person jumping, diving or falling onto the bed. The increased load applied to the bedding foundation under an abuse condition, coupled with the limited deformation resistance of the non-spring structure, often results in the non-spring structure acquiring a permanent set and being permanently damaged.

It is an object of the present invention to provide a box spring assembly which simulates a non-spring mattress foundation in terms of effective firmness while improving the structure's deformation resistance under normal abuse conditions.

In achieving the above and other objects, the present invention provides for a box spring assembly having a rectangular frame made up of side rails, end rails and a plurality of cross rails. The cross rails are generally parallel to each other and the end rails and are substantially perpendicular to the side rails. A welded wire grid or support deck is supported, generally horizontally, a predetermined distance above the frame. The support deck includes a number of straight wires arranged in criss-cross fashion. The straight wires include long wires, which extend lengthwise of the frame, and cross wires, which extend crosswise of the frame. The support deck also includes a border wire that extends around the perimeter of the support deck so as to substantially correspond with the perimeter of the frame. In addition to defining the perimeter of the support deck, the border wire also supports the long wires and cross wires.

Extending between the support deck and the frame, so as to yieldably support the support deck above the frame, are a number of spring modules or support springs. Each of the support springs is formed of spring wire and has a body made up of two side-by-side yieldable portions. The yieldable portions each include an upper column section and a lower column section connected together by a middle section. The middle section is configured so that it will bend in a substantially vertical plane in response to downwardly directed loads thereby providing the box spring assembly with the desired deformation resistance.

The yieldable portions of the support springs are unitarily formed and connected together at their upper ends by a mounting bar which extends therebetween. The mounting bar coacts with at least one of the straight wires to secure the support spring to the support deck. The lower ends of each yieldable portion are provided with a mounting foot that is attached to the frame to secure the support spring in its position.

When provided as described above, the middle sections will bend in response to a load being applied to the support spring. The middle sections provide a break in the straight line of the upper and lower column sections enabling the support spring to resist normal abuse conditions without developing a permanent set. In preferred form, the middle sections are arcuate and generally semi-circular in shape. This avoids any area of stress concentration that might weaken the support springs during bending in response to an applied load.

Additional benefits and advantages of the present invention will become apparent to those skilled in the art to which this invention relates from the subsequent description of the preferred embodiments and the append claims taken in conjunction with the accompanying drawings.

DETAILED DESCRIPTION OF THE PREFERRED EMBODIMENTS

Figure 1:
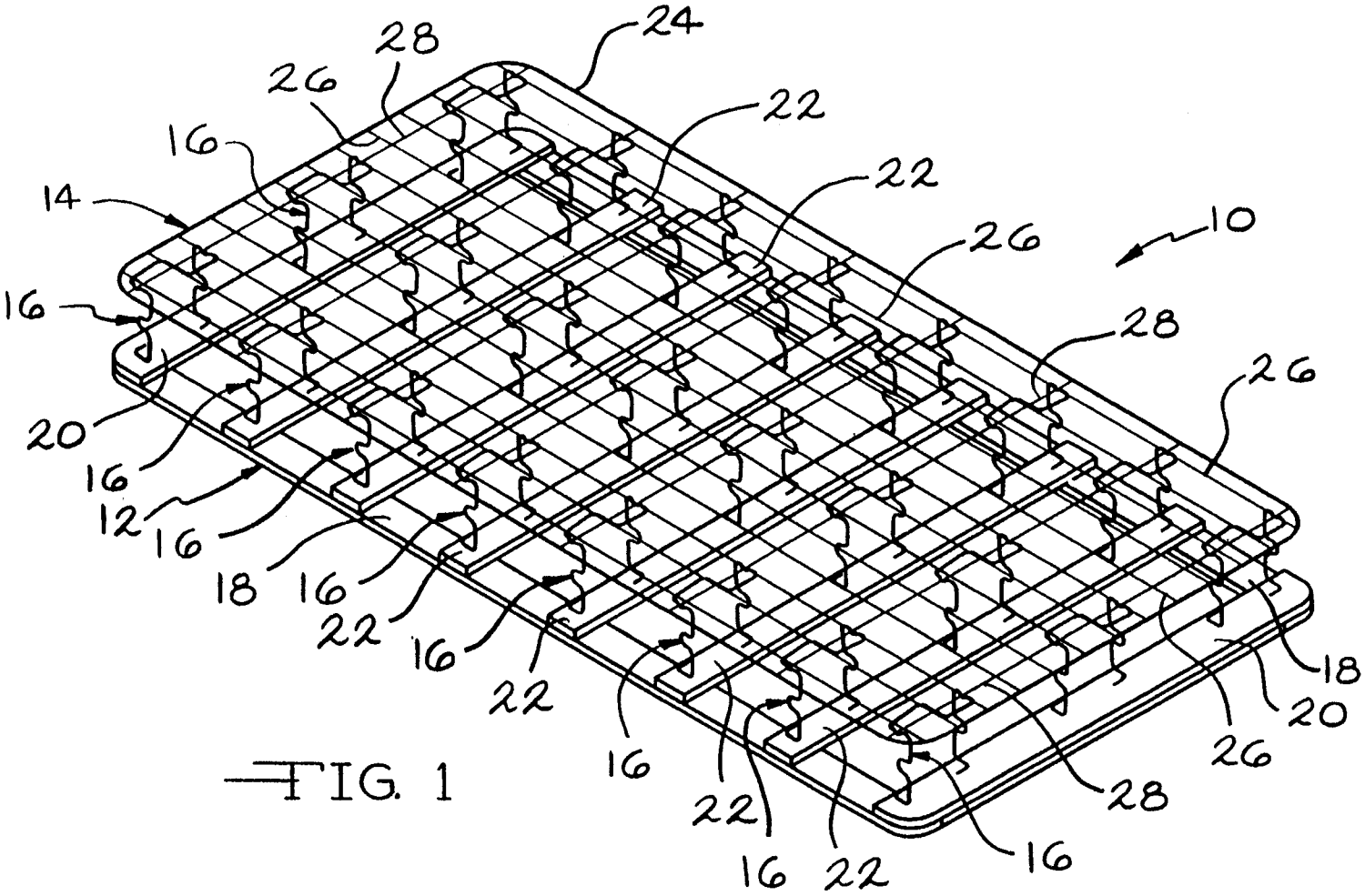
FIG. 1 is a perspective view of a box spring assembly embodying the principles of the present invention.

Referring now to the drawing, a box spring assembly incorporating the principles of this invention is illustrated in FIG. 1 and generally designated at 10. The box spring assembly 10 is shown as consisting of a frame 12, a support deck 14 and a plurality of spring modules or support springs 16.

The frame 12 is generally a horizontally disposed structure that includes side rails 18 and end rails 20 which define its substantially rectangular shape. Between the two end rails 20, a plurality of substantially parallel cross rails 22 extend from and are secured to the side rails 16. Typically, the frame 12 is constructed of wood. However, an all metal or composite frame could be used as an alternative to the illustrated embodiment.

As mentioned above, the support deck 14 is generally horizontally disposed by the support springs 16 a predetermined distance above the frame 12. The support deck 14 consists of a plurality of straight wires, arranged in a criss-cross fashion, and a border wire 24. The border wire 24 defines the perimeter of the support deck 14 and is generally rectangular in shape so as to correspond with the shape and perimeter of the frame 12. Supported by the border wire 24, the straight wires include long wires 26, which extend lengthwise of the frame 12, and cross wires 28, which extend crosswise of the frame 12.

It is preferred that the border wire 24, long wires 26 and cross wires 28 of the support deck 14 are welded together at all intersections therebetween to form a welded wire grid. This is desirable since it decreases noise which would otherwise be created as the overlapping wires rub against each other during deflection of the support springs 16. Obviously, alternate constructions for the support deck 14 could be utilized.

Figure 3:
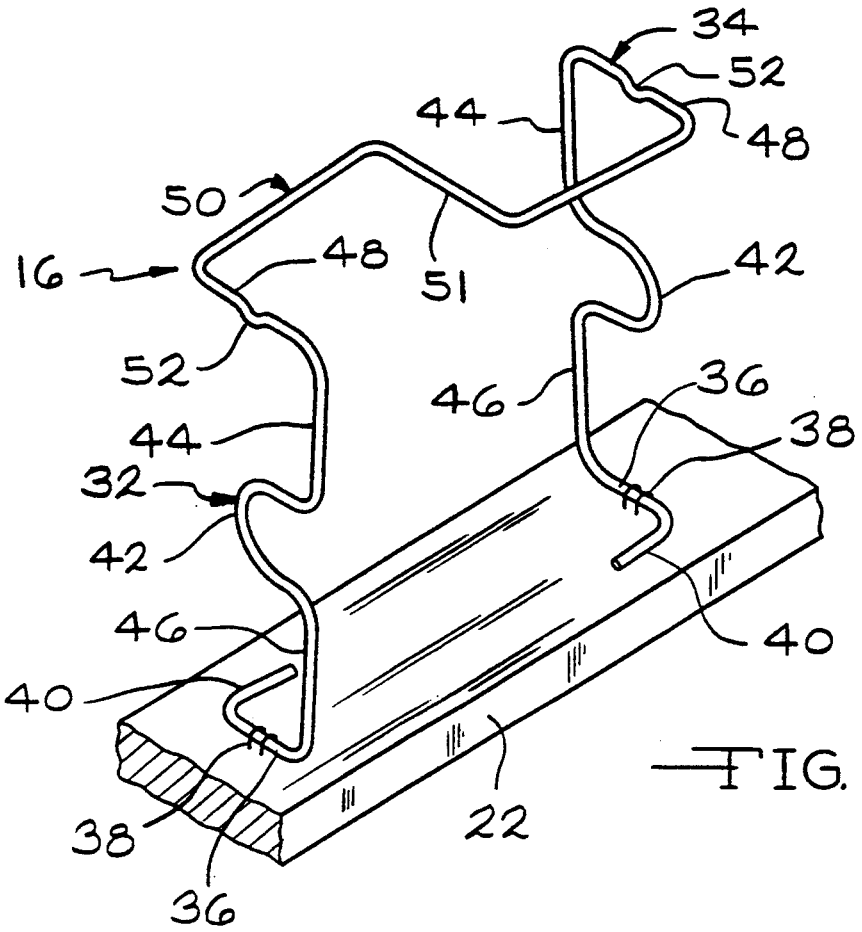
FIG. 3 is a perspective view of a support spring as incorporated in the box spring assembly shown in FIG. 1.
Figure 4:
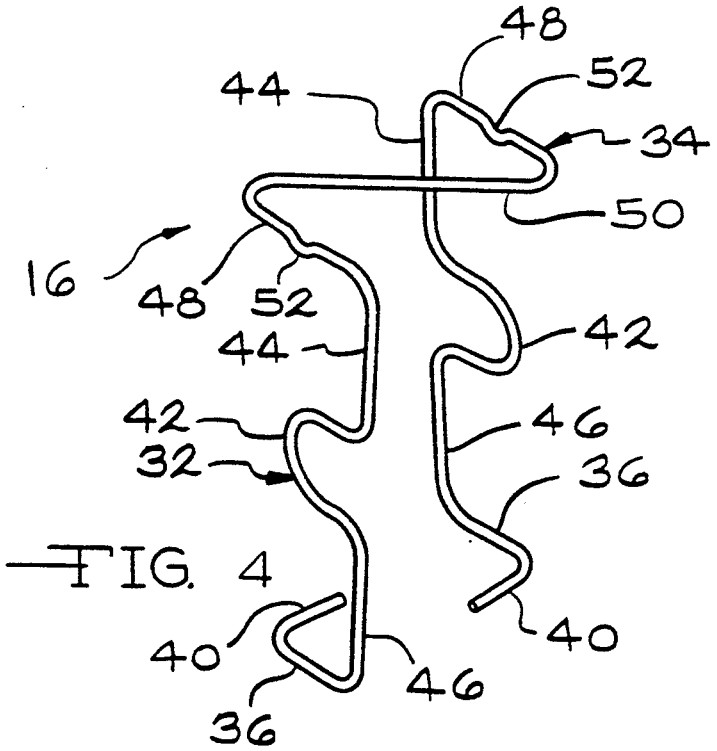
FIG. 4 is a perspective view of a support spring as incorporated into the box spring assembly shown in FIG. 2.

Referring now to FIGS. 3 and 4, two embodiments of the support springs 16 incorporating the principles of the present invention are disclosed. For the sake of clarity, elements common to both embodiments of the support springs 16 will be designed with like references.

Each support spring 16 is formed from a length of steel spring wire which is bent to from a body having a pair of side-by-side yieldable portions 32. Being unitarily formed, the yieldable portions 32 are connected together at their upper ends by a mounting portion or bar 34. The lower ends of the yieldable portions 32 are provided with mounting feet 36 which allow for securement of the support springs 16, by staples 38 or other common fasteners, to the cross rails 22 or the end rails 20. The mounting feet 36 are also provided with anti-sway bars 40. By extending from the mounting feet 36 at an angle relative thereto, the anti-sway bars 40 operate to prohibit lateral movement or rotation of the support springs 16 about axis defined by the mounting feet 36. When properly incorporated into the box spring assembly 10, the yieldable portions 32 will be positioned to extend in a substantially vertical plane between the mounting bar 34 and the mounting feet 36.

Being kept in a substantially vertical plane, the yieldable portions 32 provide the box spring assembly 10 with an effective firmness that simulates that of a non-spring mattress foundation while significantly improving deformation resistance under normal abuse conditions. In accomplishing the above, the yieldable portions 32 are provided with a middle or arcuate section 42 located between upper and lower column sections, respectively designated 44 and 46. In the prefered embodiment, the arcuate section 42 is located approximately mid-way between the mounting bar 34 and the mounting feet 36 so that the upper and lower column sections 44 and 46 are approximately the same length. The upper and lower column sections 44 and 46 are substantially straight and are oriented so as to be substantially aligned with one another along a common vertical axis defined by their lengths.

While the construction discussed above is preferred, specific design considerations of the box spring assembly may dictate that alternate locations for the arcuate sections 42 be used or that alterative non-coaxial alignments be used for the upper and lower column sections 44 and 46.

The arcuate sections 42 are designed for minimal deflection under normal working loads and form a break in the straight lines of the upper and lower column sections 44 and 46. In one working embodiment, a support spring 16 according to the present invention, constructed from nine gauge spring wire, was found to exhibit a deflection of one-eighth ($\frac{1}{8}$) inch (about 2% of the support spring 16 height) under a sixty (60) pound load. The support spring 16 also supported a two hundred and fifty (250) pound static load and repeatedly absorbed free fall loads of one hundred and fifty (150) pounds from a six inch drop height without developing a permanent set.

When the support spring 16 is loaded, the upper and lower column sections 44 and 46 move generally toward one another as the arcuate section 42 bends in a substantially vertical plane and provides the yieldable resistance to the load. Preferably, the arcuate sections 42 are semi-circular or 37 C" shaped to avoid developing any areas of stress concentration that might weaken the support spring 16. It should be understood, however, that it is within the purview of the present invention to use other arcuate shapes.

As seen in FIGS. 3 and 4, the support springs 16 are illustrated with the mounting bar 34 being provided in two variations. These variations are respectively used depending an whether it is desirable to use a short or long mounting variation. As used herein, the term mounting bar 34 includes all of the support spring 16 which connects the upper column section 44 of one yieldable portion 32 to the upper column section 44 of the other yieldable portion 32.

The mounting bar 34 is arranged so that it extends generally transversely from the upper end of one yieldable portion 32 to the upper end of the other yieldable portion 32. In so doing, the mounting bar 34 is provided with end sections 48 which extend generally perpendicular from the upper column sections 44 while remaining in the vertical plane defined by the yieldable portions 32. In this manner, the end portions 48 are substantially aligned with the mounting feet 36. A connecting section 50 extends transversely between the two end sections 48 and connects them together.

As seen in FIG. 3, the first embodiment of the support spring 16 has a connecting section 50 which is provided in a zig-zag configuration, including a middle portion 51 which is generally parallel with the two end sections 48. This variation is designed to enable mounting across three of the long wires 26, with the middle portion 51 being generally parallel and adjacent to the middle one of the three long wires 26. In the second or short mounting embodiment of the present invention, seen in FIG. 4, the connecting section 50 extends in a straight diagonal between the diagonally opposing ends of the end sections 48 and across only two of the long wires 26.

As seen in the Figures, the arcuate section 42 of one yieldable portion 32 is curved in a direction opposite that of the arcuate section 42 of the other yieldable portion 32. As a result of this, the connecting section 50 extends between diagonally opposite ends of the end sections 48.

In either embodiment of the support spring 16, the mounting bar 34 is adapted to engage one of the cross wires 28 in an over and under, interwoven fashion so as to secure the support spring 16 thereto. As such, the support spring 16 is initially positioned so that the cross wire 28 extends beneath the connecting section 50. The support spring 16 is then rotated, pivoting about the point of contact between the connecting section 50 and the cross wire 28, until the cross wire 28 extends over top of both of the end sections 48. To lock the support spring 16 in this position on the cross wire 28, the end sections 48 are provided with notches, designated at 52, which receive the cross wire 28. Alternatively, the support spring 16 could be secured to the support deck 14 using clips or other conventional methods.

In the preferred form of the invention, the support spring 16 is symmetrical about mutually perpendicular vertical planes, one extending through the notches 52 of the end sections 48 and the other extending perpendicular to the first vertical plane and bisecting the connecting section 50. The result is a support spring 16 which is substantially uniformly stressed without significant points of stress concentration that might fail and shorten the life of the entire support spring 16.

In use, the box spring assembly 10 of the present invention carries a mattress (not shown) on the support deck 14. During the application of normal bedding loads to the mattress, the loads are transmitted to the box spring assembly 10 where the upper and lower column sections 44 and 46 are loaded in compression. The applied loads are transmitted through the upper column sections 44 to the arcuate sections 42. As configured, the arcuate sections 42 bend substantially in the vertical plane defined by the yieldable portion 32 and resist the bedding loads with bending stresses.

Figure 2:
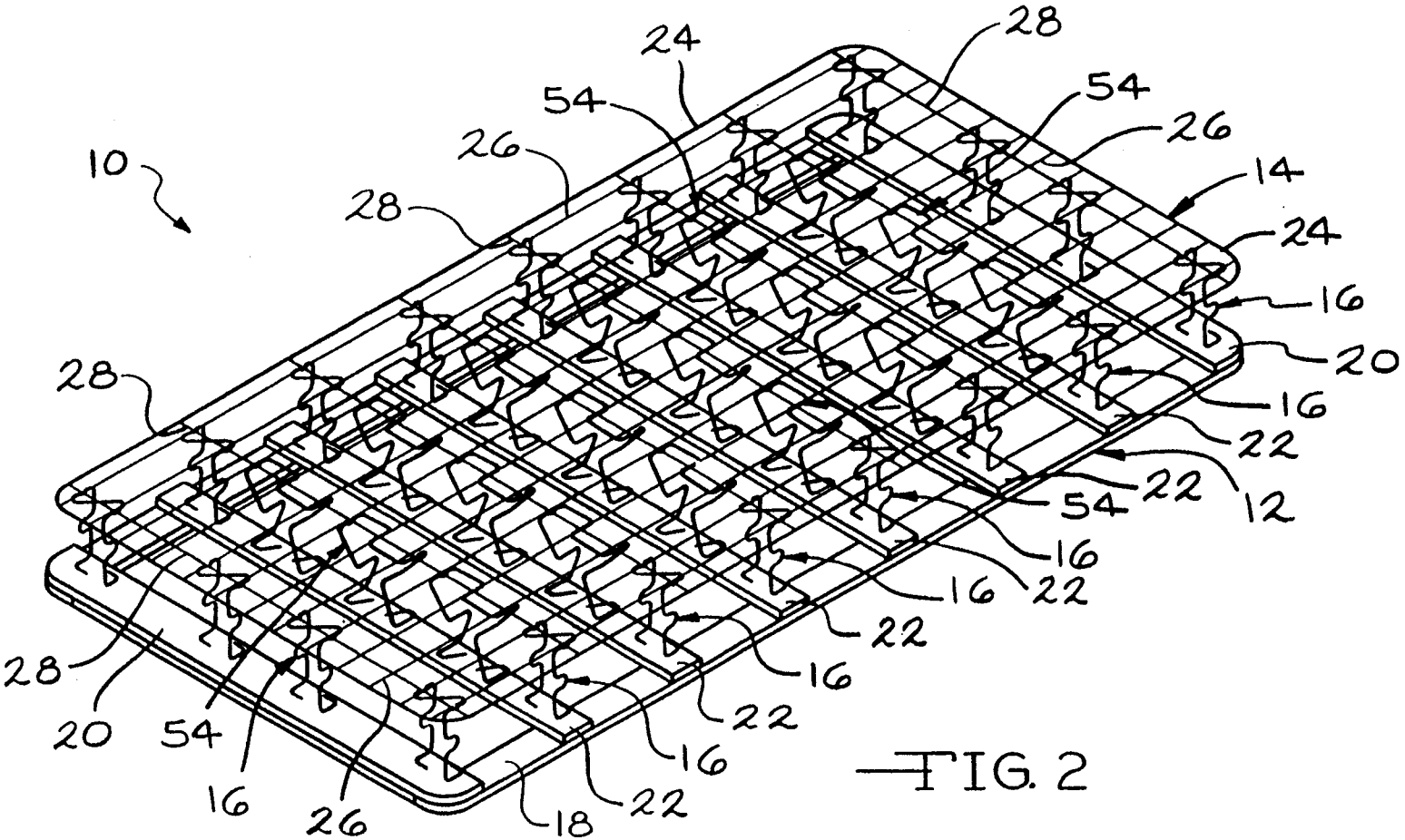
FIG. 2 is a perspective view of another embodiment of a box spring assembly incorporating the principles of the present invention.

As seen in FIGS. 1 and 2, the support springs 16 can be variously spaced to provide the box spring assembly 10 with a desired amount of support. In FIG. 1, the box spring assembly 10 is provided with support springs 16 entirely throughout its construction. The support springs 16 are illustrated as being located at equally spaced positions so that the box spring assembly 10 exhibits a substantially equal firmness throughout. In FIG. 2, the box spring assembly 10 is provided with torsion spring modules 54 in its center and with support springs 16 according to the present invention specifically being located along the assembly's perimeter. The torsion spring modules 54 located in the center of the box spring assembly 10 are less stiff and the assembly 10 of FIG. 2 thus exhibits a softer center region for sleeping comfort. The increased stiffness of the assembly perimeter, which is similar in stiffness to that offered by non-spring mattress foundations, substantially eliminates the "sliding off" feeling that accompanies a soft perimeter assembly. It is to be understood that the various embodiments of the present invention can be used interchangeably or in combination with one another so as to provide any desired support configuration for the box spring assembly 10.

From the above description, it is seen that this invention provides for an improved box spring assembly 10 that includes novel support springs having upright yieldable portions 32 with arcuate sections 42 that bend in a substantially vertical plane and form a break between upper and lower column sections 44 and 46. The support springs 16 can be arranged on the frame 12 with either uniform or non-uniform spacing to best resist anticipated loads.

While the above description constitutes the preferred embodiments of the present invention, it will be appreciated that the invention is susceptible to modification, variation and change without departing from the proper scope and fair meaning of the accompanying claims.

I claim:

1. A box spring assembly comprising:

a generally rectangular frame;

a generally horizontal support deck disposed a predetermined distance above said frame, said support deck including a plurality of straight wires arranged in criss-cross fashion, said straight wires including long wires extending lengthwise of said frame and cross wires extending crosswise of said frame, said support deck also including a border wire being of a generally rectangular shape and supporting said long wires and said cross wires; and a plurality of support springs arranged between and secured to said support deck and said frame so as to yieldably support said deck on said frame, said support springs being unitarily formed and including a pair of side-by-side yieldable portions each being oriented in a substantially vertical plane, a mounting bar means extending between the upper ends of said yieldable portions, said mounting bar means coacting with at least one of said straight wires for securing said support spring to said support deck, mounting foot means extending from the lower ends of said yieldable portions for securing said support spring to said frame, said yieldable portions each including a substantially vertical upper column section and a substantially vertical lower column section connected together by a laterally extending middle section configured to bend within a substantially vertical plane in response to downwardly directed loads.

2. A box spring assembly as set forth in claim 1 wherein said upper and lower column sections are oriented for loading in compression in response to downwardly directed loads.

3. A box spring assembly as set forth in claim 1 wherein said upper and lower column sections are coaxial.

4. A box spring assembly as set forth in claim 1 wherein said middle section is substantially equidistantly positioned between said mounting bar means and said mounting foot means.

5. A box spring assembly as set forth in claim 1 wherein said mounting foot means includes an anti-sway bar extending thereoff at an angle.

6. A box spring assembly as set forth in claim 1 wherein said middle section is of generally arcuate shape.

7. A box spring assembly as set forth in claim 6 wherein said arcuate shape of said middle section of one of said yieldable portions is curved in one direction and said arcuate shape of said middle section of the other of said yieldable portions is curved in an opposite direction.

8. A box spring assembly as set forth in claim 1 wherein said middle section is C-shaped.

9. A box spring assembly as set forth in claim 1 wherein said arcuate section is semi-circular.

10. A box spring assembly as set forth in claim 1 wherein said support springs are positioned generally adjacent to said border wire and substantially around the perimeter of said box spring assembly.

11. A box spring assembly as set forth in claim 1 wherein said support springs are generally spaced throughout said box spring assembly.

12. In a box spring assembly having a frame and a support deck disposed a predetermined distance above the frame, a support spring comprising a unitarily formed body having a pair of side-by-side yieldable portions including upper and lower ends, a mounting bar means extending between said upper ends of said yieldable portions for securing said support spring to the support deck, said mounting bar means including an end section extending from each of said upper ends of said yieldable portions and a connecting section extending between said upper end sections, said connecting section having a zig-zag shape and including a middle portion substantially parallel with both of said end sections, mounting foot means extending from said lower ends of said yieldable portions for securing said support spring to the frame and orienting said yieldable portions in a substantially vertical plane, said yieldable portions each including a substantially vertical upper column section and a substantially vertical lower column section connected together by a laterally extending middle section configured to bend within said substantially vertical plane in response to downwardly directed loads, said middle section of one of said yieldable portions being configured in a direction opposite of said middle section of the other of said yieldable portions.

13. A support spring as set forth in claim 12 wherein said middle sections are arcuate in shape.

14. A support spring as set forth in claim 12 wherein said middle sections are semi-circular in shape.

15. A support spring as set forth in claim 12 wherein said middle sections are generally "C" shaped.

16. In a box spring assembly having a frame and a support deck disposed a predetermined distance above the frame, a support spring comprising a unitarily formed body having a pair of side-by-side yieldable portions including upper and lower ends, a mounting bar means extending between said upper ends of said yieldable portions for securing said support spring to the support deck, said mounting bar means including an end section extending from each of said upper ends of said yieldable portions and a connecting section extending between said upper end sections, said connecting section being straight and extending between diagonally opposite portions of said end sections, mounting foot means extending from said lower ends of said yieldable portions for securing said support spring to the frame and orienting said yieldable portions in a substantially vertical plane, said yieldable portions each including a substantially vertical upper column section and a substantially vertical lower column section connected together by a laterally extending middle section configured to bend within said substantially vertical plane in response to downwardly directed loads, said middle section of one of said yieldable portions being configured in a direction opposite of said middle section of the other of said yieldable portions.

17. A support spring as set forth in claim 16 wherein said middle sections are arcuate in shape.

18. A support spring as set forth in claim 16 wherein said middle sections are semi-circular in shape.

19. A support spring as set forth in claim 16 wherein said middle sections are generally "C" shaped.

* * * * *